United States Patent [19]

Hoffmann

[11] 4,225,190

[45] Sep. 30, 1980

[54] MINING DRUM WITH CUTTING AND SHEARING BITS ON CONICAL RING

[76] Inventor: Dieter Hoffmann, Holthauser Strasse 39, D-4320 Hattingen, Ruhr, Fed. Rep. of Germany

[21] Appl. No.: 967,703

[22] Filed: Dec. 6, 1978

[51] Int. Cl.[2] ..... E21C 25/10

[52] U.S. Cl. ..... 299/89; 299/87

[58] Field of Search ..... 299/80, 87, 89, 90

[56] References Cited

U.S. PATENT DOCUMENTS

| | | | |
|---|---|---|---|
| 3,718,369 | 2/1973 | Anderson | 299/90 X |
| 3,847,439 | 11/1974 | Allen | 299/81 |

FOREIGN PATENT DOCUMENTS

| | | | |
|---|---|---|---|
| 1349873 | 4/1974 | United Kingdom | 299/87 |

*Primary Examiner*—Ernest R. Purser

*Attorney, Agent, or Firm*—Spencer & Kaye

[57] ABSTRACT

A mining auger includes an auger shaft having a front end, a conical end ring affixed to the front end of the auger and having a forwardly oriented face and a peripheral edge zone; a plurality of tool holders affixed to the peripheral edge zone in a circumferential distribution and each having a forwardly oriented face; and a cutting tool bit carried in each tool holder. Each cutting tool bit projects forwardly beyond a peripheral edge of the conical end ring and has a longitudinal axis extending at an inclined orientation with respect to an imaginary frontal plane which is perpendicular to the auger axis and which generally coincides with the mine wall face during operation. At least some of the tool holders carry a shearing tool bit each having an axis extending from the forwardly oriented face of the conical end ring in the direction of the frontal plane and further, each shearing tool bit has a tip which is at a significant distance from the forwardly oriented face of the respective tool holder.

15 Claims, 2 Drawing Figures

MINING DRUM WITH CUTTING AND SHEARING BITS ON CONICAL RING

BACKGROUND OF THE INVENTION

This invention relates to a mining auger used in particular for the underground mining of coal. It has a conically shaped frontal terminal body (hereafter "end ring") which has along its outer edge a plurality of peripherally distributed spaced cutting tool holders in which individual cutting tool bits are secured. The longitudinal axis of each cutting tool is oriented at an inclination to an imaginary frontal plane of the auger. This frontal plane is defined here as being oriented perpendicularly to the auger axis and touching the tips of each cutting tool bit. Thus, during operation of the mining auger, the thus defined frontal plane generally coincides with the face of the mine wall, assumed to extend perpendicularly to the auger axis. Further, the cutting tool bits project beyond the outer edge of the conical end ring.

Mining augers with single or multiple auger helices for the underground mining are generally known. They conventionally have a hollow auger shaft to the outer face of which a single auger helix or a plurality of auger helices are welded. To the edge zone of the helix, tool holders are welded at equal distances. Each tool holder carries a cutting tool bit. The end face of the mining auger oriented towards the mining wall is closed by an end plate. Further, mining augers of this type are conventionally provided with a conical end ring which is welded to the end plate. The conical end ring too, is, at its outer edge projecting towards the mining wall, provided with uniformly spaced tool holders in which cutting tool bits are arranged. These cutting tool bits project to a significant measure beyond the outer peripheral edge of the conical end ring in the direction of the mine wall. It has further been proposed to so shape the end plate that it has a frustoconical configuration when viewed cross sectionally or to provide an end plate which has a planar (radial) central part and a frustoconical part welded to the circular edge of the planar, disc-like part. In the latter case, the radially arranged disc-shaped portion of the end ring is connected with the auger shaft. The conical configuration provides that a force transmission between the mining auger and the mine wall is reduced. This improves efficiency and also reduces dust generation during operation. It has already been recognized in this connection that any deviation from a radial arrangement of the end plate leads to an improvement. It has thus been already recognized that the cone angle, that is, the angle between any line which extends radially outwardly from the auger shaft parallel with the end ring face and the axis of the auger shaft yields advantages if the angle is less than 90°. Cone angles between 30° and 85° are conventional; a preferred cone angle range is approximately between 50° and 70°. Advantageous results have been achieved with a cone angle of approximately 60°.

It has been found in practice that the use of conical end rings substantially entirely meets the expectations. Heretofore, however, it has been a disadvantage that the service life of the conical end rings has been relatively short, presumably, because the outer circumferential zone of the conical end ring of the otherwise conical terminal body forms a frictional (scouring) edge at the mine wall; thus, this zone of the end ring is exposed to significantly large wear. This also applies to edge zones of the tool holders which are arranged in the conical end ring and which thus, similarly to the free edge zone of the conical end ring, wear extremely rapidly. Mining augers having a conical end ring and finding application in underground mining have been worn to such an extent after a few operational periods that they can no longer operate satisfactorily. It is not unusual that entire edge zones of the conical end ring break off. In addition, a substantial number of tool holders disappear entirely from the edge zone. In such cases the damaged mining augers can be repaired only by cutting off the old conical end ring by a welding torch and replacing it with a new one, since in most cases it is simply not worthwhile to repair the damaged edge zones by welding new parts thereinto.

SUMMARY OF THE INVENTION

It is an object of the invention to provide an improved mining auger of the above-outlined type in which the wear of the conical end ring is substantially reduced as compared to prior art arrangements.

This object and others to become apparent as the specification progresses, are accomplished by the invention, according to which, briefly stated, the mining auger includes an auger shaft having a front end, a conical end ring affixed to the front end of the auger and having a forwardly oriented face and a peripheral edge zone; a plurality of tool holders affixed to the peripheral edge zone in a circumferential distribution and each having a forwardly oriented face; and a cutting tool bit carried in each tool holder. Each cutting tool bit projects forwardly beyond a peripheral edge of the conical end ring and has a longitudinal axis extending at an inclined orientation with respect to an imaginary frontal plane which is perpendicular to the auger axis and which generally coincides with the mine wall face during operation. At least some of the tool holders carry a shearing tool bit each having an axis extending from the forwardly oriented face of the conical end ring in the direction of the frontal plane and further, each shearing tool bit has a tip which is at a significant distance from the forwardly oriented face of the respective tool holder.

By virtue of the invention, the free edge zone of the end ring and that of the tool holders no longer scour the mine wall. On the contrary, the shearing tool bits provided according to the invention ensure that the zones of the conical end ring oriented towards the mine wall and particularly the edge zones of the tool holders oriented towards the mine wall are protected. It has been found that in this manner the service life of the conical end ring and the tool holders can be increased very substantially, for example, by 25 to 80%. As a result, a mining auger structured according to the invention may be maintained in operation for a much longer period than in case of conventional mining augers with conical end rings. The result is a substantial cost saving.

According to a further feature of the invention, the free end of each shearing tool bit projects towards the frontal plane beyond that edge of the tool holder which is oriented towards the mine wall. In this manner a particularly effective protection of the tool holder is ensured, particularly as concerns its forwardly oriented edge zones.

According to a further feature of the invention, the longitudinal axis of each shearing tool bit and the longitudinal axis of the associated cutting tool bit form a right angle or an angle differing from the right angle by a small acute angle. This arrangement provides a particularly efficient arrangement of the shearing tool bits, since it ensures that a particularly large zone of the conical end ring is protected against wear and other damage. Further, the service life of the tool holders is very significantly extended. In this embodiment, the shearing tool bits with the respective cutting tool bits may be held in a very robust, yet relatively compact structure.

According to further features of the invention, the longitudinal axis of each shearing tool bit is arranged at 90° (or at an angle deviating from 90° by an acute angle) to the forwardly oriented face of the end ring. Further, the longitudinal axis of each shearing tool bit is oriented at an obtuse angle to the above-defined frontal plane of the mining auger and has a value of approximately 135° to 145°, preferably 140°. These arrangements are particularly favorable; they can be realized with relatively economical and simple means.

DESCRIPTION OF THE PREFERRED EMBODIMENT

Figure 1:
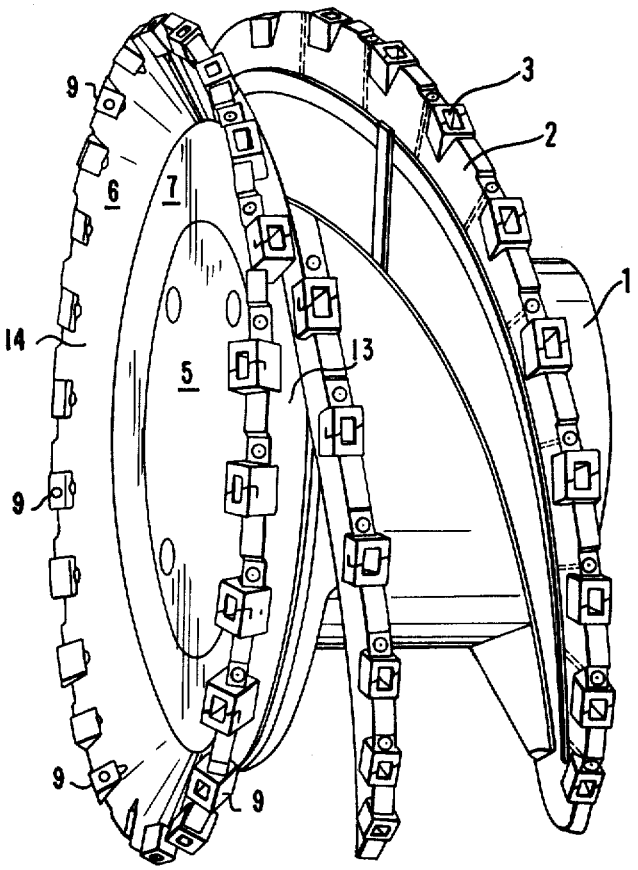
FIG. 1 is a perspective view of a mining auger (without tool bits) adapted to incorporate the invention.
Figure 2:
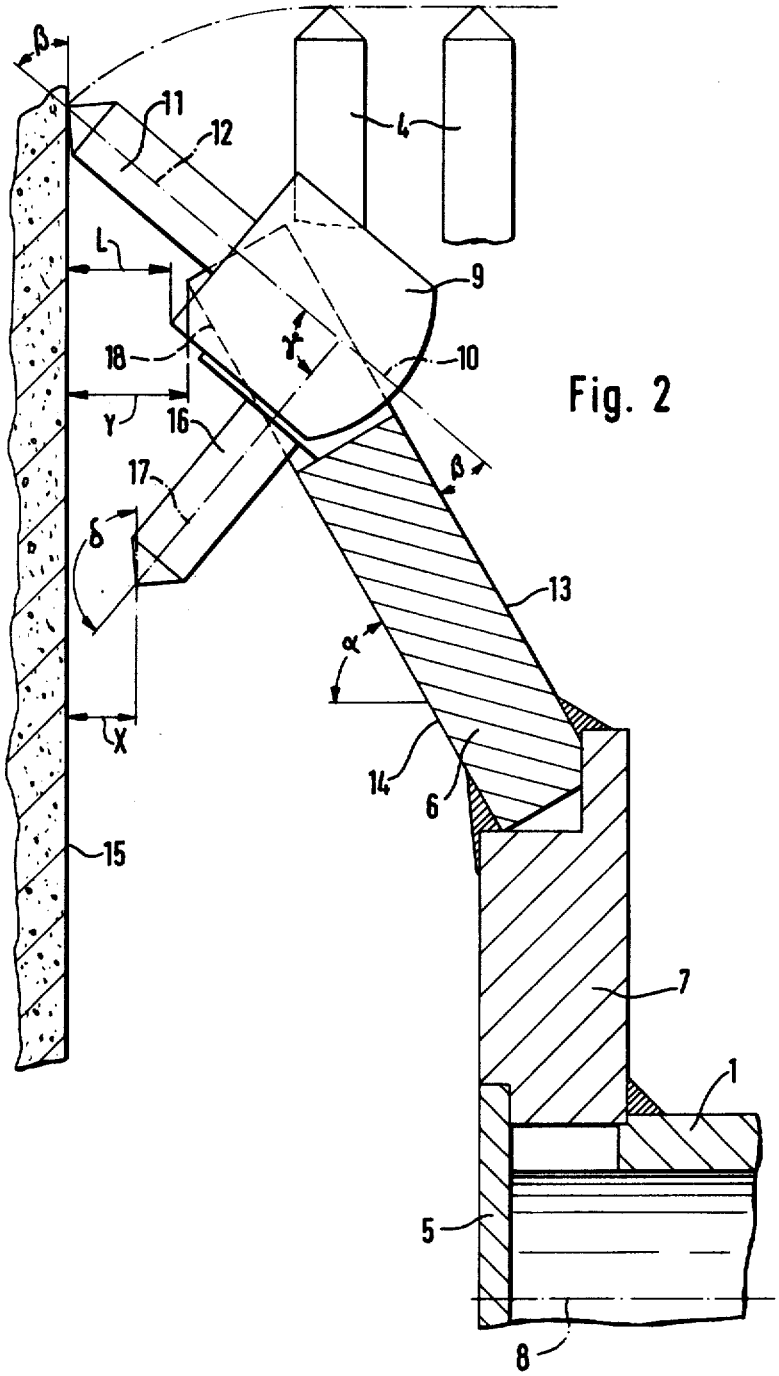
FIG. 2 is a fragmentary axial sectional view of the structure shown in FIG. 1 illustrating a preferred embodiment of the invention.

Turning now to the Figures, the mining auger which, in particular, is used in the underground mining of coal, has a hollow auger shaft 1 on which there is arranged a single auger helix 2. The helix 2 is formed of a sheet metal member which is welded in an edgewise upright orientation helically about the shaft surface. On its outer circumference the helix 2 is provided at uniform distances with tool holders 3 which are firmly connected to the helix 2 by means of welds. In the tool holders there are conventionally arranged outwardly projecting cutting tool bits which, for the sake of simplicity, are not shown in FIG. 1. In FIG. 2, two such cutting tools 4 are schematically illustrated which, by virtue of their arrangement on the spirally extending helix 2, appear to be positioned side-by-side in this Figure.

The mining auger further has a closure plate 5 as well as a conical end ring 6, 7 which has an outer conical part 6 and inner part 7 which, in turn, is arranged radially with respect to the auger axis 8. It is to be understood that by "conical end ring" there is throughout this description meant either an end ring which is throughout conical, or as in the structure illustrated, has also a radial portion 7. By "conical end ring" there are further to be understood structures in which the frontal part of the end plate 5, together with the other portions of the end ring have a frustoconical configuration.

The cone angle $\alpha$ is 60° in the described embodiment; it may have other values, for example, within the range of 30° to 85°, particularly in the range of 50° and 70°.

In the zone of the free edge of the conical end ring 6 there are provided, along its outer periphery, a plurality of tool holders 9 (only one shown in FIG. 2). The longitudinal axis 10 of each tool holder coincides with the longitudinal axis 12 of each cutting tool bit 11 arranged in the respective tool holder 9. In this embodiment the longitudinal axes 10 and 12 extend at an acute angle $\beta$ with respect to that face 13 of the conical end ring 6 which is oriented rearwardly, that is, away from the mine front 15. As a result, the axis 12 of the respective cutting tool bit 11 too, forms, with the mine face 15 (which, during operation, coincides with the imaginary frontal plane of the mining auger) the angle $\beta$ which, in the embodiment illustrated amounts to 20°. The tip of the cutting tool bit 11 is at a distance L ahead of the forwardmost edge of the respective tool holder 9.

According to the invention, some or all of the tool holders 9 of the conical end ring 6 are provided with a shearing tool bit 16, whose longitudinal axis 17 extends from the forwardly oriented face 14 of the conical end ring 6 or, stated differently, from the side 18 of the respective tool holder 9. The orientation of each shearing tool bit 16 is such that its tip is at a significant distance ahead of the side 18 of the tool holder 9, in the direction of the mine face 15. As it may be observed in FIG. 2, the longitudinal axes 10 and 12 of the tool holder 9 and the cutting tool bit 11 intersect the longitudinal axis 17 of the shearing tool bit 16 and enclose therewith the angle $\gamma$ which is a right angle in the illustrated embodiment. The angle $\gamma$ may be an acute angle or an obtuse angle and may deviate from 90° upwardly or downwardly by an angle range of 2° to 12°, preferably by an angle range of $\pm 3°$.

The tip of each shearing tool bit 16 terminates at a distance X from the mine face 15. Or, stated differently, the tips of the shearing tool bits 16 lie in a plane which is parallel to the frontal plane of the auger and which is spaced therefrom at the distance X in the direction of the end ring 6, 7. Both L and X are measured parallel to the auger axis 8. In the illustrated embodiment the distance X is significantly smaller than the distance L and amounts to approximately two-thirds of the distance L.

Stated generally, the tip of each shearing tool bit 16 is spaced from the frontal plane 15 towards the conical end ring 6, but is closer to the frontal plane 15 than any part of the conical end ring 6 or any part of each tool holder 9. Thus, as seen in FIG. 2, the closest distance between the tool holder 9 and the frontal plane 15 is L, the closest distance between the conical end ring 6 and the frontal plane 15 is Y. Both L and Y are greater than X which is the distance between the tip of shearing tool bit 16 and the frontal plane 16.

$\delta$ designates the angle which opens towards the end ring face 14 and under which the axis 17 of the shearing tool bit 16 is inclined with respect to the mine face 15 (or the frontal plane of the auger). In the illustrated embodiment the angle $\delta$ is approximately 140°; it may, however, have a larger value, dependent upon the fluctuations of the angle $\gamma$.

During operation, the shearing tool bits 16 protect particularly the faces 14 and the upper edge zone of the conical end ring 6 as well as the face 18 of the tool holder 9 and its edge oriented towards the mine face 15. As a result, in these portions there occurs a significantly reduced wear by virtue of the fact that these components no longer constitute scouring edges. Thus, the service life of all these parts are very significantly prolonged.

It is to be understood that the above description of the present invention is susceptible to various modifications, changes and adaptations, and the same are intended to be comprehended within the meaning and range of equivalents of the appended claims.

What is claimed is:

1. In a mining auger including an auger shaft having a front end, a conical end ring affixed to the front end of the auger and having a forwardly oriented face and a peripheral edge zone; a plurality of tool holders affixed to the peripheral edge zone in a circumferential distribution and each having a forwardly oriented face; a cutting tool bit each having an axis and each being affixed to a separate tool holder; each cutting tool bit projecting forwardly beyond a peripheral edge of the conical end ring; each cutting tool bit having an outer tip and a longitudinal axis extending at an inclined orientation with respect to an imaginary frontal plane which is perpendicular to the auger axis and touches the tip of the cutting tool bit; the improvement wherein at least some of said tool holders carry a shearing tool bit each having an axis extending from said forwardly oriented face of said conical end ring in the direction of said frontal plane; further wherein each said shearing tool bit has a tip being spaced from said frontal plane in the direction of said conical end ring; and further wherein each said tip being closer to said frontal plane than any part of said conical end ring and any part of said tool holders.

2. A mining auger as defined in claim 1 wherein each said tool holder has an edge oriented towards said frontal plane and wherein each said outer tip of said shearing tool bit projects beyond said edge of the respective tool holder in the direction of said frontal plane.

3. A mining auger as defined in claim 2, wherein the tips of said shearing tool bits lie in a plane which is parallel with said frontal plane and which is spaced from said frontal plane in the direction of said end ring.

4. A mining auger as defined in claim 1 wherein the axis of the shearing tool bits and the axis of the respective cutting tool bits together define a right angle.

5. A mining auger as defined in claim 4, wherein the shearing tool bit axes extend at 90° to said forwardly oriented face of said conical end ring.

6. A mining auger as defined in claim 4, wherein the shearing tool bit axes and said forwardly oriented face of said conical end ring together define an angle which deviates from 90° by an acute angle.

7. A mining auger as defined in claim 4, wherein each shearing tool bit axis is oriented at an obtuse angle to said frontal plane and wherein said obtuse angle opens towards said forwardly oriented face of said end ring.

8. A mining auger as defined in claim 7, wherein said obtuse angle is approximately between 135° and 145°.

9. A mining auger as defined in claim 7, wherein said obtuse angle is approximately 140°.

10. A mining auger as defined in claim 1 wherein the axis of the shearing tool bits and the axis of the respective cutting tool bits together define an angle which deviates from 90° by an acute angle.

11. A mining auger as defined in claim 10, wherein the shearing tool bit axes extend at 90° to said forwardly oriented face of said conical end ring.

12. A mining auger as defined in claim 10, wherein the shearing tool bit axes and said forwardly oriented face of said conical end ring together define an angle which deviates from 90° by an acute angle.

13. A mining auger as defined in claim 10, wherein each shearing tool bit axis is oriented at an obtuse angle to said frontal plane and wherein said obtuse angle opens towards said forwardly oriented face of said end ring.

14. A mining auger as defined in claim 13, wherein said obtuse angle is approximately between 135° and 145°.

15. A mining auger as defined in claim 13, wherein said obtuse angle is approximately 140°.

* * * * *